US007793936B2

(12) United States Patent
Caputo

(10) Patent No.: US 7,793,936 B2
(45) Date of Patent: Sep. 14, 2010

(54) DRAW FOR BATTLE

(75) Inventor: Anthony Carmine Caputo, Plainfield, IL (US)

(73) Assignees: Anthony C. Caputo, Plainfield, IL (US); Edward H. Guy, Irvine, CA (US)

( * ) Notice: Subject to any disclaimer, the term of this patent is extended or adjusted under 35 U.S.C. 154(b) by 0 days.

(21) Appl. No.: 12/492,952

(22) Filed: Jun. 26, 2009

(65) Prior Publication Data

US 2009/0261530 A1 Oct. 22, 2009

Related U.S. Application Data

(62) Division of application No. 11/554,028, filed on Oct. 29, 2006, now abandoned.

(51) Int. Cl.
*A63F 9/20* (2006.01)

(52) U.S. Cl. ..... 273/308; 273/292; 273/296; 434/85; 434/96

(58) Field of Classification Search ..... 273/292, 273/293; 434/85, 96
See application file for complete search history.

(56) References Cited

U.S. PATENT DOCUMENTS 2,634,132 A 4/1953 Freedman
3,419,971 A * 1/1969 Ribken ..... 434/88
4,801,147 A 1/1989 Miller
5,386,999 A 2/1995 Rice
5,586,238 A * 12/1996 Murata ..... 345/629
6,601,851 B1 8/2003 Sakamoto et al.
7,144,013 B2 12/2006 Tanaka
7,469,901 B1 12/2008 Hilliard
2003/0085520 A1 5/2003 Bedford et al.
2005/0082759 A1 4/2005 Strahan
2006/0202423 A1 9/2006 Tanaka

* cited by examiner

*Primary Examiner*—Gene Kim
*Assistant Examiner*—Joseph B Baldori
(74) *Attorney, Agent, or Firm*—Mind Law Firm; Justin G. Sanders; Jeromye V. Sartain

(57) ABSTRACT

The present invention, referred to as DRAW FOR BATTLE, is a strategic dueling card game, combining an art instructional component as part of interactive card game play. Players must first draw the characters chosen from the PRIMARY DECK during game play before placing them onto the battlefield for combat through assigned numerical STRENGTH levels and SMARTS levels. The game includes a PRIMARY DECK, which itself includes ADD cards, DRAW cards, MORPH cards, and WILD cards, and the THINK DECK, which describes an intellectual way of defeating the brute through various THINK cards, and if it was successful or not. The BATTLE CARD TABLET is a set of preprinted oversized cards, with a grid pattern for guidance during drawing, in tablet form to create battle cards. The MASTER DECK is a series of oversized cards that provide the basic instructions for illustrating the characters and their back-story.

5 Claims, 8 Drawing Sheets

DRAW FOR BATTLE

RELATED APPLICATIONS

This is a divisional application of a prior filed and currently pending application having Ser. No. 11/554,028 and filing date of Oct. 29, 2006.

This application claims priority and is entitled to the filing date of U.S. non-provisional application Ser. No. 11/554,028 filed Oct. 29, 2006, and entitled "Draw for Battle." The contents of the aforementioned application are incorporated by reference herein.

BACKGROUND OF THE INVENTION

Incorporation by Reference

Applicant(s) hereby incorporate herein by reference any and all U.S. patents and U.S. patent applications cited or referred to in this application.

FIELD OF THE INVENTION

Aspects of this invention relate generally to card games, and more particularly to a strategic dueling card game, combining an art instructional component as part of interactive card game play.

SUMMARY OF THE INVENTION

Aspects of the present invention teach certain benefits in construction and use which give rise to the exemplary advantages described below.

The present invention, referred to as DRAW FOR BATTLE, is a strategic dueling card game, combining an art instructional component as part of interactive card game play. Players must first draw the characters chosen from the primary deck during game play before placing them onto the battlefield for combat through assigned numerical power levels and intelligent levels. The game includes a PRIMARY DECK, which includes ADD cards, DRAW cards, MORPH cards, and WILD cards, and the THINK DECK, which describes an intellectual way of defecting the brute, and if it was successful or not. The BATTLE CARD TABLET is preprinted oversized cards, with the grid pattern for guidance during drawing, in tablet form to create battle cards. The MASTER DECK is a series of oversized cards that provide the basic instructions for illustrating the characters, and their back-story.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

DETAILED DESCRIPTION OF THE INVENTION

The above described drawing figures illustrate aspects of the invention in at least one of its exemplary embodiments, which are further defined in detail in the following description.

Figure 1:
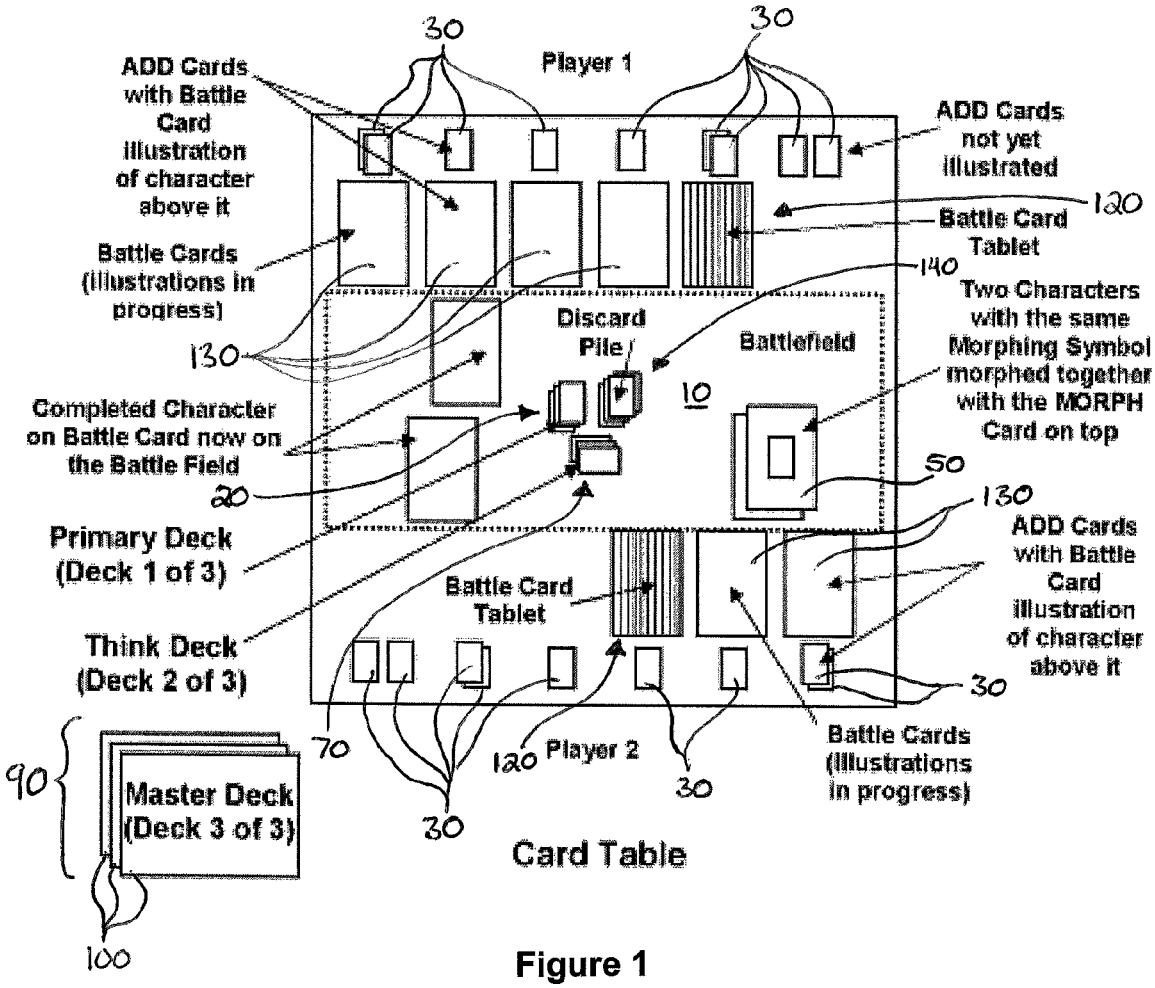
FIG. 1 is a schematic view of the present invention in use, illustrating the battlefield, the PRIMARY DECK, the THINK DECK, the MASTER DECK, and the BATTLE CARD TABLET.

Referring first to FIG. 1, DRAW FOR BATTLE is a strategic dueling card game, combining an art instructional component as part of interactive card game play. Players must first draw the characters chosen from the PRIMARY DECK 20 during game play before placing them onto the battlefield 10 for combat through assigned numerical power levels and intelligent levels. The game includes a PRIMARY DECK 20, which includes ADD cards 30 (FIG. 2), DRAW cards 40 (FIG. 3), MORPH cards 50 (FIG. 4), and WILD cards 60 (FIG. 5), and the THINK DECK 70, which describes an intellectual way of defeating the brute, and if it was successful or not. The BATTLE CARD TABLET 120 is preprinted oversized battle cards, with the battle card grid pattern 122 for guidance during drawing, in tablet form to create battle cards 130. The MASTER DECK 90 is a series of oversized MASTER cards 100 that provide the basic instructions for illustrating the characters, and their back-story.

The DRAW FOR BATTLE game includes essentially two different preprinted decks for game play: the PRIMARY DECK 20; and the THINK DECK 70, each of which is discussed in more detail further below.

Figure 8:
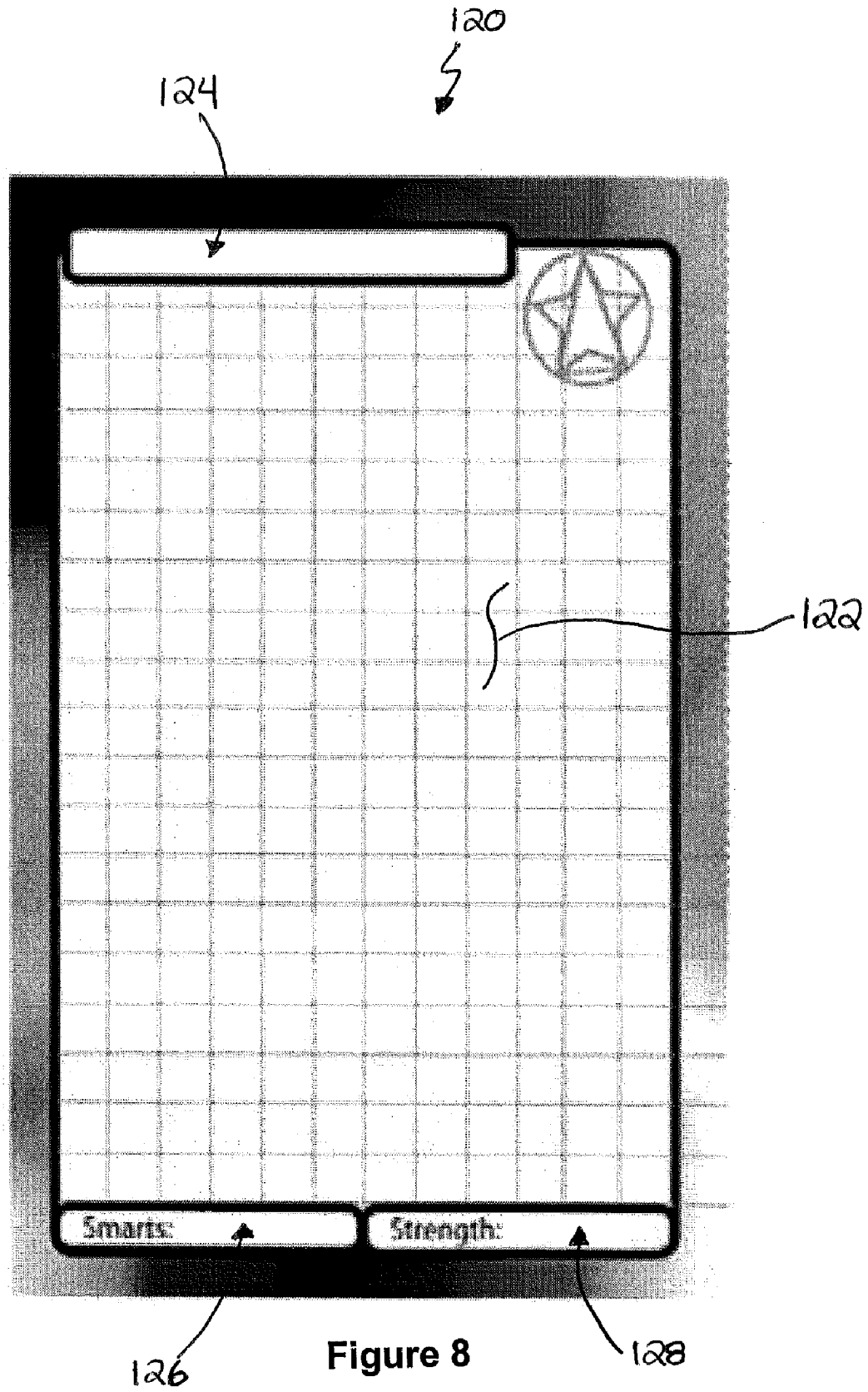
FIG. 8 is an enlarged schematic view of an exemplary BATTLE CARD TABLET of the present invention.

As a threshold matter, as best shown in FIG. 8, the BATTLE CARD TABLET 120 used during the game is a set of preprinted oversized cards, with the battle card grid pattern 122 for guidance during drawing, in tablet form to create battle cards 130. The BATTLE CARD TABLET 120 also includes a name field 124 for writing in the name of the character being drawn as dictated by the corresponding ADD card 30, more about which is said below. In addition, each BATTLE CARD TABLET 120 also includes a SMARTS field 126 and a STRENGTH field 128 for writing in the SMARTS score 38 and STRENGTH score 39 shown on the ADD card 30 for the particular character being drawn (FIG. 2).

The PRIMARY DECK 20 resembles an ordinary playing card set of about 120 cards. The PRIMARY DECK 20 includes ADD cards 30, DRAW cards 40, MORPH cards 50, and WILD cards 60.

Figure 2:
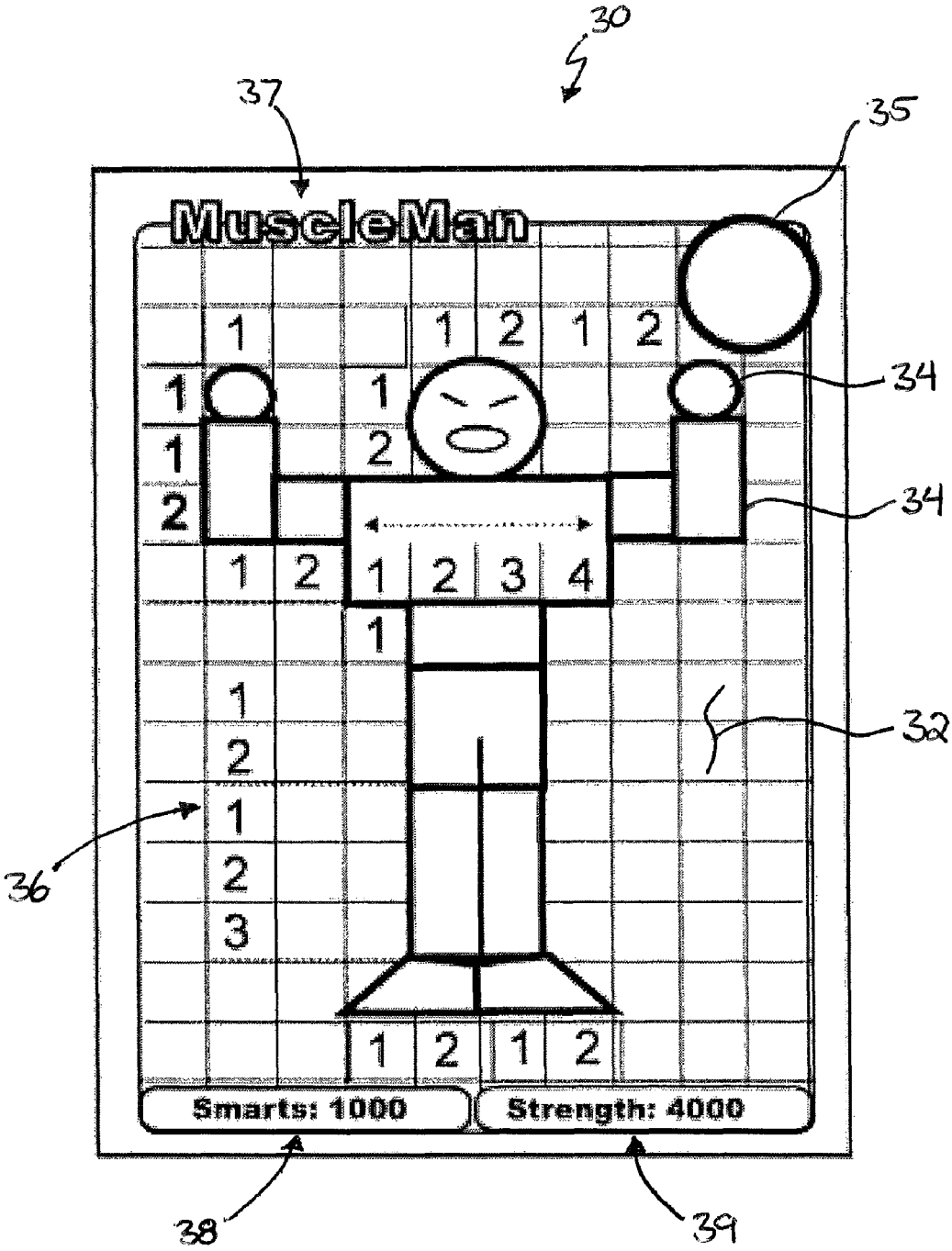
FIG. 2 is an enlarged schematic view of an exemplary ADD card of the present invention included in the PRIMARY DECK.
Figure 3:
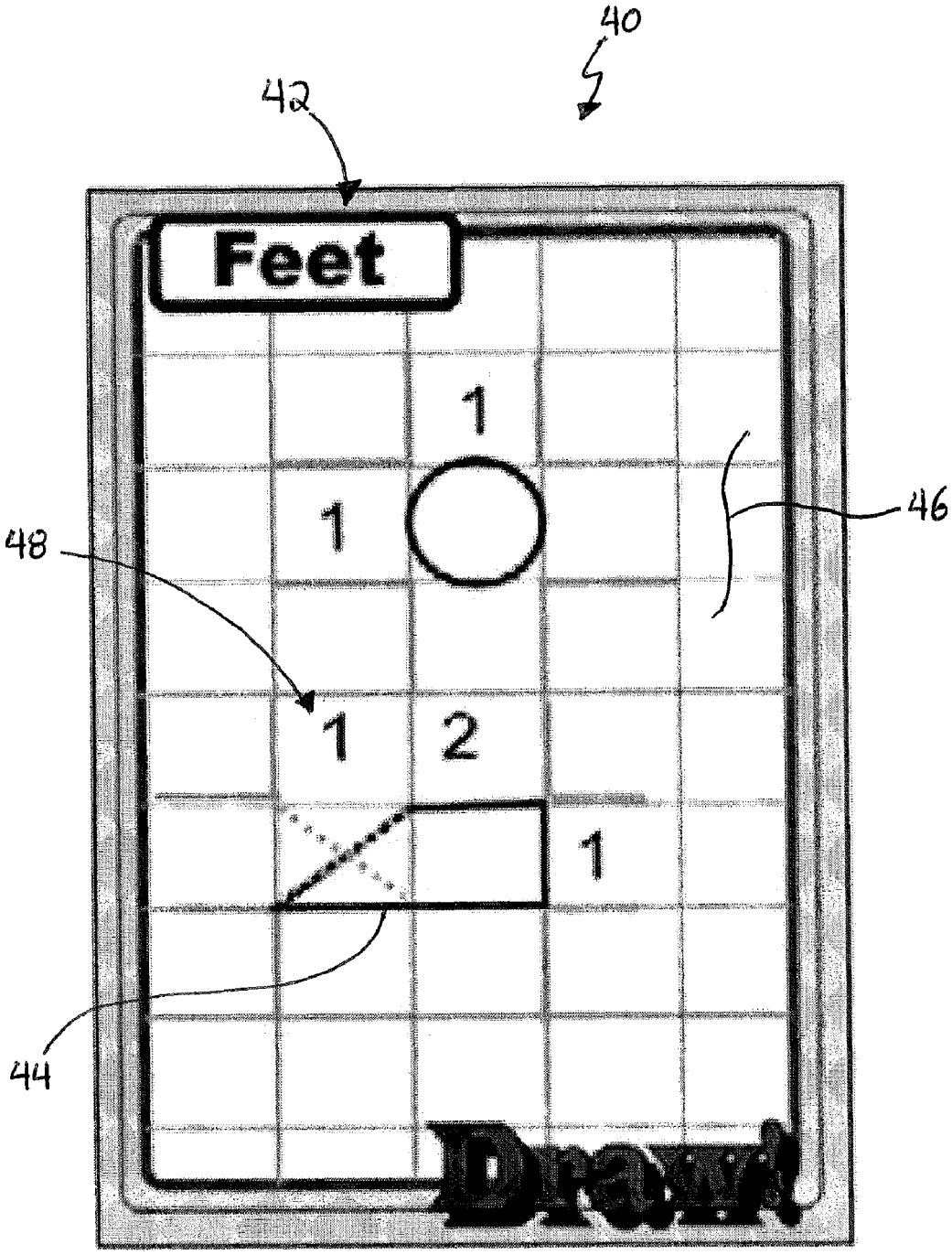
FIG. 3 is an enlarged schematic view of an exemplary DRAW card of the present invention included in the PRIMARY DECK.
Figure 4:
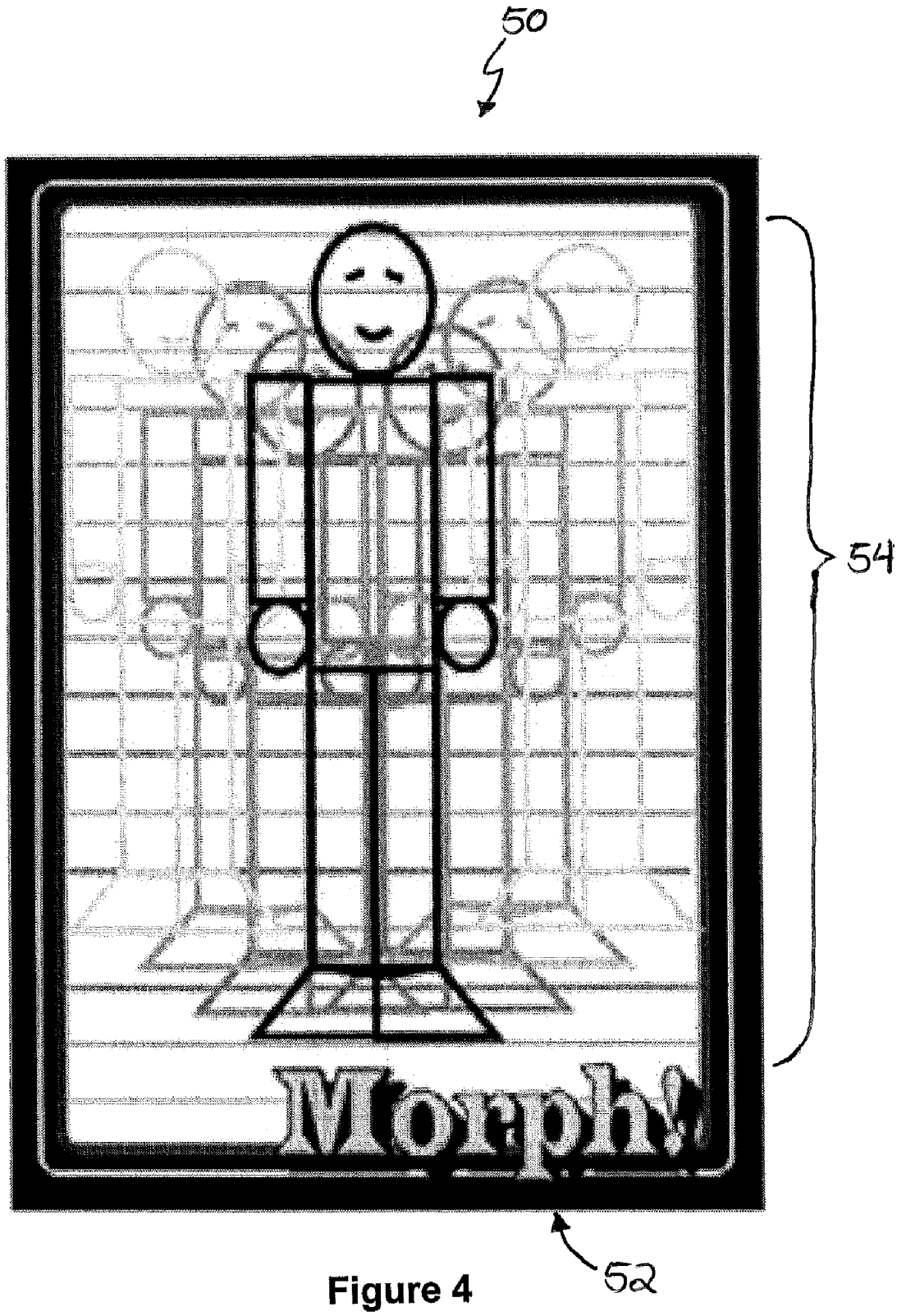
FIG. 4 is an enlarged schematic view of an exemplary MORPH card of the present invention included in the PRIMARY DECK.

Turning to FIG. 2, the ADD cards 30 give permission to the player to start drawing that character on the BATTLE CARD TABLET 120, and once completed, add them onto the battlefield 10. Each ADD card 30 included in the PRIMARY DECK 20 (FIG. 1) presents a unique character and its drawing dimensions, using the add card grid 32. The character is assigned a morph symbol 35, more about which is said below in connection with FIG. 4, given a character name 37, and assigned a SMARTS score 38 and a STRENGTH score 39, all of which are indicated on the ADD card 30 as shown in the exemplary embodiment. Specifically, on the add card grid 32 there is pre-drawn the designated character using character geometric shapes 34 such as squares, rectangles, circles and triangles fitted to the add card grid 32 in a particular pattern so as to form the character. The add card grid 32 may also include adjacent each of the shapes 34 character numbers 36 representing the grid dimension of each shape 34 along a particular edge or diameter, which numbers 36 further guide the player in drawing the character onto the BATTLE CARD TABLET 120 (FIGS. 1 and 8). This is where the DRAW cards 40 come into play, as best shown in FIG. 3. During game play, the player must pick a DRAW card 40 from the PRIMARY DECK 20 (FIG. 1) to allow and instruct how to draw that specific part of the anatomy of the character shown on each ADD card 30 the player is holding. For instance, if a player picks up an ADD Potbelly Dragon card from the deck, the player keeps it. The player may have several ADD cards 30 of various characters, but cannot use any of those characters on the battlefield 10 until DRAW cards 40 for each of the body parts (head, arms, legs, body, and face, etc), are chosen and drawn completely on the BATTLE CARD TABLET 120 to create his battle cards 130 (FIG. 1). In more detail, each DRAW card 40 includes a body part name 42, which in the exemplary embodiment is "Feet," and a body part geometric shape 44 according to the body part pre-drawn on the draw card grid 46 in appropriate dimensional proportion as designated by one or more grid dimensions or body part numbers 48 to again guide the player in drawing the same body part on the BATTLE CARD TABLET 120 according to the ADD card 30 picked up by the player and designating the character to be drawn during play.

Once the player completes drawing the character on the BATTLE CARD TABLET 120, the drawing itself becomes the battle card 130 (FIG. 1).

Referring now to FIG. 4 and with continued reference to FIG. 1, the MORPH cards 50 in the PRIMARY DECK 20 allow the player to combine two or more of their completed battle cards 130 (FIG. 1), which are in the same morph class, designated by morph symbols 35 on the cards (star, pyramid or circle) (FIG. 2), for a more powerful warrior by adding their SMARTS scores 38 and STRENGTH scores 39 together as indicated on the corresponding ADD cards 30 for the characters that led to the battle cards 130 being "morphed."

Figure 5:
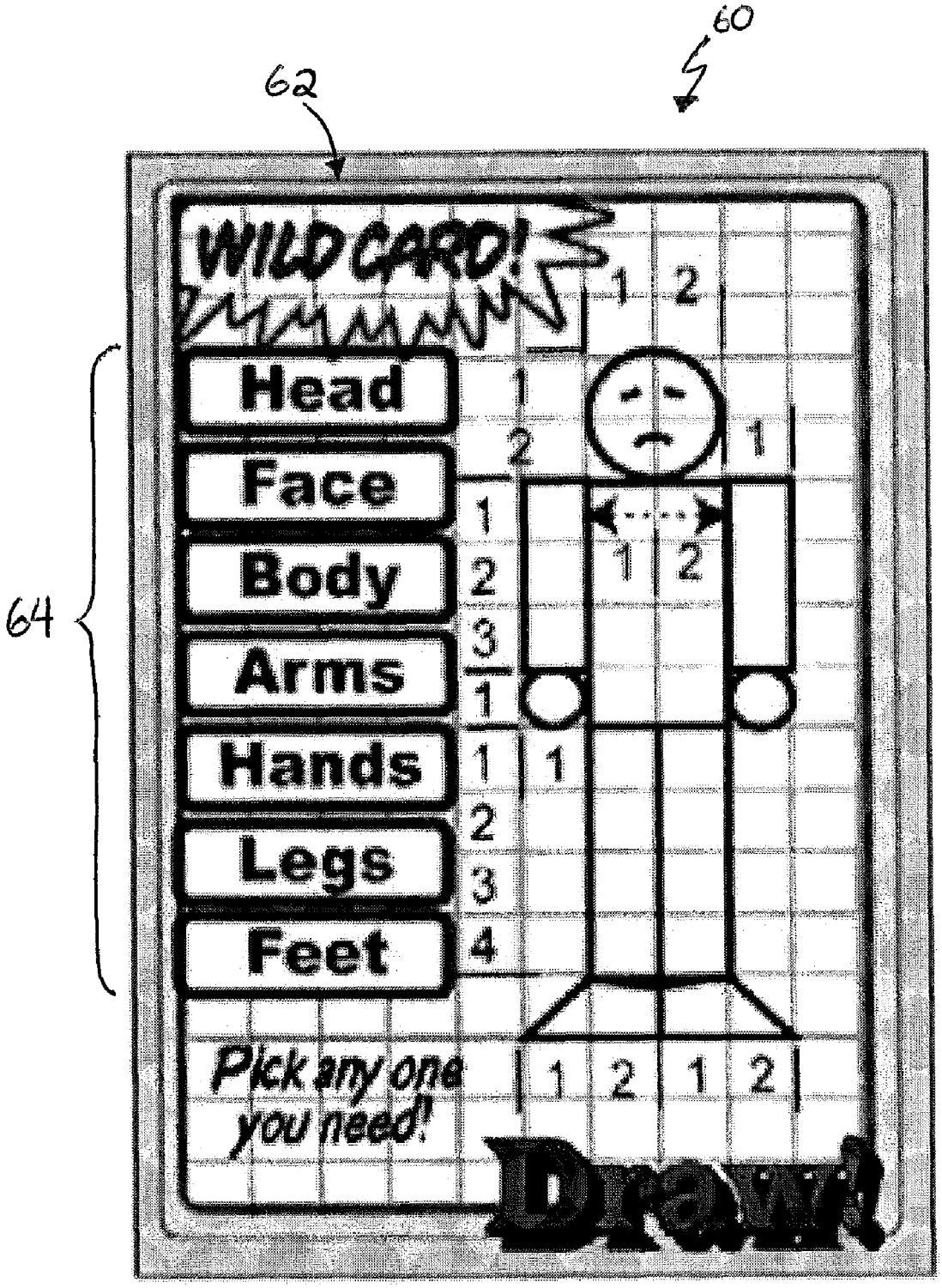
FIG. 5 is an enlarged schematic view of an exemplary WILD card of the present invention included in the PRIMARY DECK.

Finally regarding the PRIMARY DECK 20, as best shown in FIG. 5, the WILD card 60 allows the player to draw any part of the anatomy they may need in order to complete a character on their battle card 120 as shown on an ADD card 30 the player has previously picked up from the PRIMARY DECK 20. Each WILD card 60 includes a "WILD CARD" designation 62 and a listing 64 of all body parts that can be selectively drawn by the player using the WILD card 60.

Figure 6:
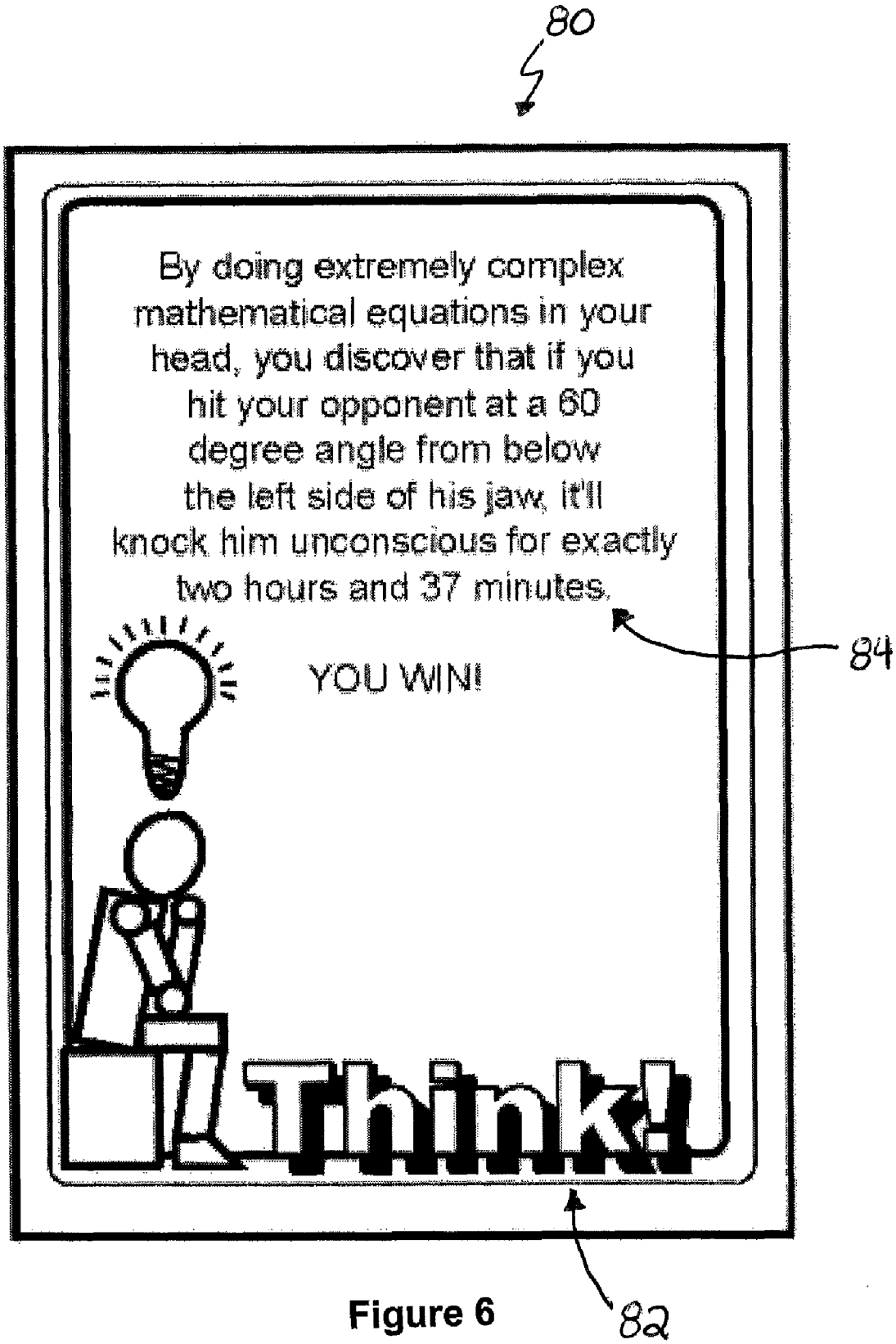
FIG. 6 is an enlarged schematic view of an exemplary THINK card of the present invention included in the THINK DECK.

Turning to FIG. 6 and with continued reference to FIG. 1, while doing battle on the battlefield 10, if one character is attacked by an opposing warrior with a larger STRENGTH score 39, but has a higher SMARTS score 38, this opens up the opportunity to pick a THINK card 80 from the THINK DECK 70, which describes an intellectual way of defeating the adversary, and if it was successful or not. For example, as shown in the exemplary THINK card 80 of FIG. 6, each such card includes a "Think!" designation 82 and a "Think!" message 84 essentially providing instructions as to which character wins the battle.

Figure 7:
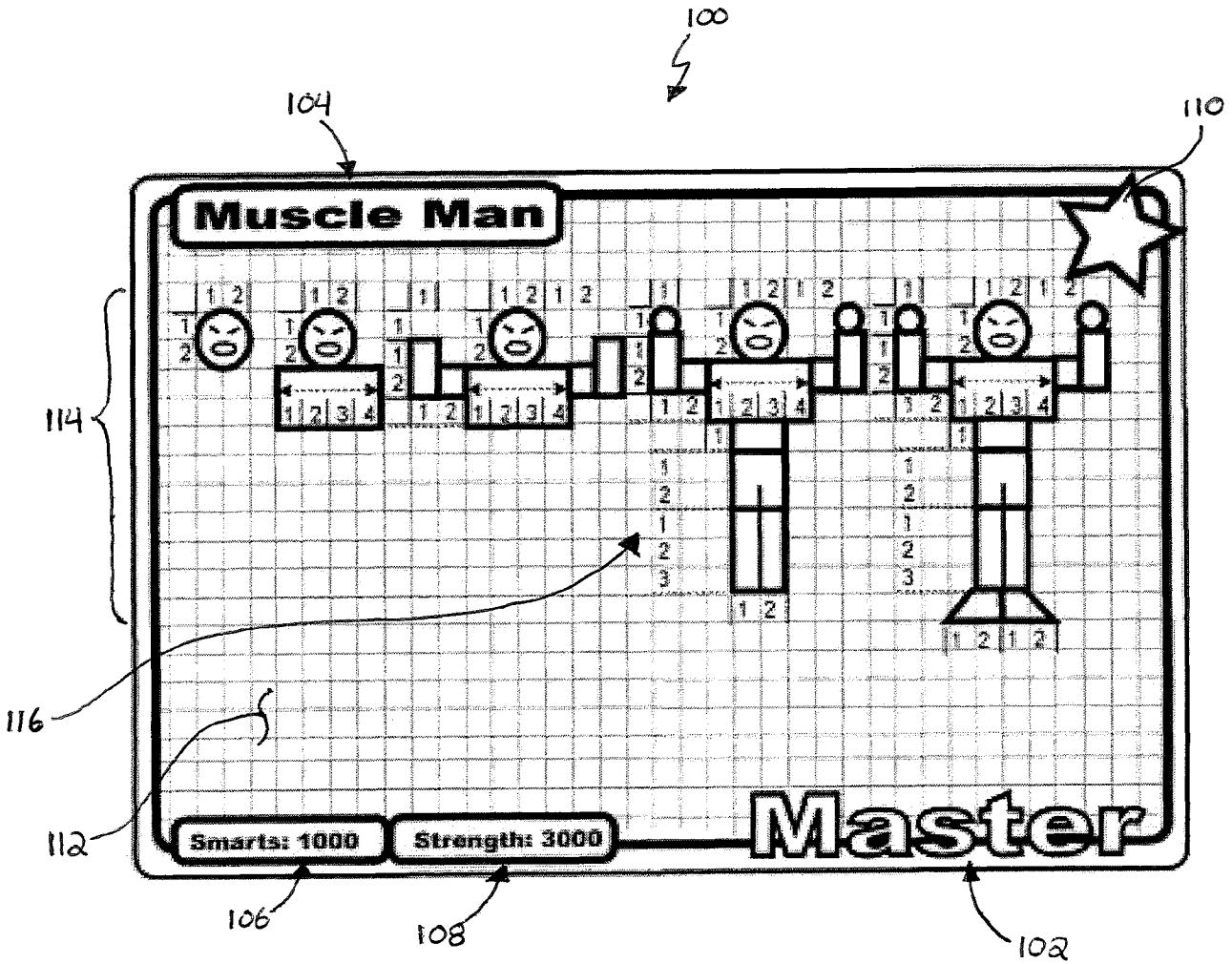
FIG. 7 is an enlarged schematic view of an exemplary MASTER card of the present invention included in the MASTER DECK.

Referring to FIG. 7 along with continued reference to FIG. 1, the MASTER DECK 90 is only accessible when a player picks up any DRAW card 40 or WILD card 60 from the PRIMARY DECK 20. The MASTER DECK 90 is a series of oversized MASTER cards 100 that provide the basic instructions for illustrating the characters, back-story and details about the character's place of origin and life. As such, each MASTER card 100 in the MASTER DECK 90 depicts each step of the drawing process for a particular character using the DRAW cards 40. Players can only take the MASTER card 100 of a specific character once that character has been picked up on an ADD card 30 from the PRIMARY DECK 20. As shown in FIG. 7, an exemplary MASTER card 100 includes a "Master" designation 102, a character name 104, a SMARTS score 106 and STRENGTH score 108 for the subject character, and a morph symbol 110 for morphing the subject character with other characters having the same morph symbol. Each MASTER card 100 then once more includes on a master card grid 112 the body parts 114 from head to feet in an exemplary sequence by which the character may be drawn. As on the ADD cards 30, the grid 112 may also include adjacent each of the shapes 114 body numbers 116 representing the grid dimension of each shape 114 along a particular edge or diameter, which numbers 116 further guide the player in drawing the character onto the BATTLE CARD TABLET 120 (FIGS. 1 and 8). The MASTER cards 100 may also include other text regarding the character's background, tips for drawing the character, and the like (not shown).

In use, with reference again primarily to FIG. 1, the PRIMARY DECK 20 cards are placed face down in front of the players to form a "draw" pile. The MASTER DECK 90 is placed to the side face up for later use in pulling out character-specific MASTER cards 100 corresponding to ADD cards drawn by a player during play, as explained further below. The THINK DECK 70 is placed face down perpendicular to the PRIMARY DECK 20. A "discard" pile 140 will be formed during play adjacent to the PRIMARY DECK 20 and the THINK DECK 70. The PRIMARY DECK 20 and THINK DECK 70 are distinguishable on the back sides of the cards in the exemplary embodiment by including the text "The Pencil is Mightier than the Sword" on the PRIMARY DECK 20 cards and a "light bulb" icon on the THINK DECK 70 cards. As a further part of the setup, each player is given a BATTLE CARD TABLET 120. Then, to commence play, each player takes a turn picking a card from the top of the PRIMARY DECK 20. If the card chosen is an ADD card 30, then the player keeps it face down. Unless the player already has an ADD card 30 on his or her field, all other cards drawn (DRAW card 40, MORPH card 50, or WILD card 60) must be discarded face down in the "discard" pile 140. But if the player already possesses an ADD card in his or her field when a DRAW card 40 or WILD card 60 is drawn from the PRIMARY DECK 20 on that player's next turn, then the player's "summons stage" begins, giving the player permission to draw that part of the character's anatomy identified on the DRAW card 40 or selected from the WILD card 60 on that player's BATTLE CARD TABLET 120. At this point is when the player would flip over the ADD card 30 corresponding to the character the player is summoning, or beginning to draw, which character will do battle for that player on the battlefield 10 against other player's characters once the player has completed drawing the entire anatomy on the BATTLE CARD TABLET 120 so as to create a battle card 130. Once the player has drawn the particular anatomy or body part corresponding to the DRAW card 40 or WILD card 60 drawn by that player from the PRIMARY DECK 20 on that turn, the same card 40, 60 is then discarded face down in the "discard" pile 140. It is again noted that at the time the first DRAW card 40 or WILD card 60 is drawn, the player can seek out the corresponding MASTER card 100 from the MASTER DECK 90 to further guide the player in drawing the character designated in the ADD card 30 on the BATTLE CARD TABLET 120. There are only a maximum of seven ADD cards 30 allowed per player on the battlefield 10 and only a maximum of seven in the progress of being drawn. If a player picks a MORPH card 50 from the PRIMARY DECK 20 on any given turn, the player can choose to morph two of his or her characters together, which not only increases the combined character's STRENGTH and SMARTS scores, but also enables the player to count the resulting character as one rather than two characters, giving the player the option of picking another ADD card 30 and beginning drawing another character for the battlefield 10. If a player already has the maximum of seven ADD cards 30 in process during a turn when another ADD card 30 is then drawn from the PRIMARY DECK 20, the player must discard the ADD card 30 face down in the "discard" pile 140. That player can keep another ADD card 30 only when one of the seven "in process" battle cards 130 are completed and added to the battlefield 10. Again, more than seven characters can effectively be on the battlefield 10 at any given time only through the use of the MORPH cards 50, if drawn. When a player chooses to do battle on the battlefield 10, he or she forfeits their chance to drawn from the PRIMARY DECK 20 and fight based on their designated STRENGTH score only. For example, if a first player's character has a STRENGTH score of 5,000 and a second player's character has a STRENGTH score of only 3,000, then the first player's character can defeat the second player's character in battle. However, if the character attacked has a higher SMARTS score than the attacking character, the defending player can pick a THINK card 80 from the THINK DECK 70 to see if his or her character has outsmarted the attacking brute. Defeated characters are returned to the bottom of the "discard" pile 140. Only one character can be summoned into battle against an opposing player's character at a time, though again two characters morphed together count as one. If the player who initiated the battle wins, they can pick a card from the PRIMARY DECK 20 on the same turn.

During play, a player can use ADD cards 30 from the deck 20 or the MASTER cards 100 as a drawing reference and/or use their imagination to create their own version of the character (with the same battle value). Once the character is fully illustrated on a battle card 130, again, it can then be placed on the battlefield 10 for combat based on STRENGTH score or based on a duel of wits resulting from a player with a character having a higher SMARTS score then drawing a THINK card 80 from the THINK DECK 70. Play continues on this basis until the winner is declared as the player having the last character "standing" on the battlefield 10.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A method of playing a card game wherein players draw characters during game play that then engage in battle, comprising the steps of:

selecting an add card from a primary deck, the add card depicting a particular character to be drawn as represented by a character name, a smarts score and a strength score for the character, and character geometric shapes arranged on an add card grid to form the character;

selecting a draw card from the primary deck, each draw card depicting one or more body parts to be drawn in forming the character, each body part represented by a body part name and a body part geometric shape as pre-drawn on a draw card grid of the draw card;

drawing the body parts shown on the draw cards on a battle card tablet to form the character shown on the add card and so create a battle card; and battling two characters according to one of the strength score and the smarts score of each character by placing the battle cards corresponding to the characters onto a battlefield.

2. The method of claim 1 further comprising the steps of:

selecting a morph card from the primary deck, the morph card containing a morph symbol; and combining two or more characters having the same morph symbol depicted on the add cards corresponding to the characters to form a single character for battle on the battlefield having strength and smarts scores of the combined characters.

3. The method of claim 1 further comprising the step of picking from a master card deck a master card corresponding to the character on an add card selected by a player, each master card containing a "Master" designation, the character name, the smarts score and strength score for the character, a morph symbol for morphing the character with other characters having the same morph symbol, and a master card grid bearing the body parts by which the character may be drawn in sequence onto the battle card tablet to form the battle card.

4. The method of claim 1 wherein the step of drawing the body parts is further guided by character numbers on the add card grid adjacent the character geometric shapes representing the grid dimension of each character geometric shape and by body part numbers on the draw card grid adjacent the body part geometric shape representing the grid dimension of each body part geometric shape.

5. The method of claim 1 wherein the step of battling two characters further comprises the steps of:

comparing the smarts scores of the respective characters to determine the character having the higher smarts score; and the player having the character with the higher smarts score selecting a think card from a think deck, each think card containing a "Think!" designation and a "Think!" message providing instructions as to which character wins the battle regardless of the strength scores of the respective characters.

* * * * *